US010260231B2

(12) United States Patent
Scherrer

(10) Patent No.: US 10,260,231 B2
(45) Date of Patent: Apr. 16, 2019

(54) HERMETIC AND ACOUSTICALLY ABSORBENT ASSEMBLY FOR A FALSE PARTITION

(71) Applicant: Jean-Marc Scherrer, Riedisheim (FR)

(72) Inventor: Jean-Marc Scherrer, Riedisheim (FR)

( * ) Notice: Subject to any disclaimer, the term of this patent is extended or adjusted under 35 U.S.C. 154(b) by 17 days.

(21) Appl. No.: 14/652,559

(22) PCT Filed: Oct. 31, 2013

(86) PCT No.: PCT/FR2013/052615

§ 371 (c)(1),
(2) Date: Jun. 16, 2015

(87) PCT Pub. No.: WO2014/102473

PCT Pub. Date: Jul. 3, 2014

(65) Prior Publication Data

US 2015/0330073 A1 Nov. 19, 2015

(30) Foreign Application Priority Data

Dec. 31, 2012 (FR) ..... 12 62985

(51) Int. Cl.

| | |
|---|---|
| ***E04B 1/84*** | (2006.01) |
| ***E04B 9/32*** | (2006.01) |
| ***E04B 1/86*** | (2006.01) |
| *E04B 1/82* | (2006.01) |
| *E04B 9/30* | (2006.01) |
| *F21V 33/00* | (2006.01) |

(52) U.S. Cl.

CPC ..... *E04B 1/84* (2013.01); *E04B 1/8409* (2013.01); *E04B 1/86* (2013.01); *E04B 9/303* (2013.01); *E04B 2001/8281* (2013.01); *E04B 2001/8433* (2013.01); *E04B 2001/8452* (2013.01); *F21V 33/006* (2013.01)

(58) Field of Classification Search

CPC ..... E04B 1/84; E04B 9/32; E04B 9/36; E04B 2001/8428; E04B 2001/8433

USPC ..... 181/289

See application file for complete search history.

(56) References Cited

U.S. PATENT DOCUMENTS 2,935,151 A * 5/1960 Watters ..... E04B 9/34 181/289
3,253,675 A * 5/1966 Baruch ..... E04B 9/001 181/289

(Continued)

FOREIGN PATENT DOCUMENTS

DE 9320543 11/1994
DE 19943478 C2 * 11/2002 ..... E04B 9/04

(Continued)

*Primary Examiner* — Edgardo San Martin

(74) *Attorney, Agent, or Firm* — Bachman & LaPointe, P.C.

(57) ABSTRACT

An acoustically absorbent assembly intended to constitute, inside premises, a partition element able to be fixed to at least one partition for producing false partitions, comprising: two fabrics parallel to each other and assembled on an attachment means at a periphery of the two fabrics, the fabrics defining respectively an inner fabric and an outer fabric when the assembly is fixed to the partition, one of the fabrics being free from perforations, wherein the outer fabric is disposed at a given distance from the inner fabric and the outer fabric comprises microperforations configured as an acoustic fabric.

12 Claims, 2 Drawing Sheets

(56) References Cited

U.S. PATENT DOCUMENTS

| | | | | |
|---|---|---|---|---|
| 3,460,299 | A * | 8/1969 | Wilson | E04B 9/303 181/286 |
| 5,782,551 | A * | 7/1998 | Capaul | B32B 15/14 362/148 |
| 5,942,736 | A * | 8/1999 | Cortonesi | E01F 8/0017 181/210 |
| 6,367,581 | B1 * | 4/2002 | Marler | B66B 11/0226 181/295 |
| 7,658,046 | B2 * | 2/2010 | Lynch | B32B 3/266 362/148 |
| 9,147,390 | B2 * | 9/2015 | Swinkels | G10K 11/172 |
| 9,194,124 | B2 * | 11/2015 | Johnson | E04B 9/32 |

FOREIGN PATENT DOCUMENTS

| | | | | |
|---|---|---|---|---|
| EP | 0046559 | | 3/1982 | |
| EP | 0941684 | | 9/1999 | |
| EP | 2078796 | | 7/2009 | |
| EP | 2472018 | | 7/2012 | |
| EP | 2054562 | B1 * | 2/2013 | E04B 1/8409 |
| EP | 2659071 | B1 * | 5/2015 | E04B 9/303 |
| FR | 3000509 | A1 * | 7/2014 | E04B 1/8409 |
| WO | WO0120091 | | 3/2001 | |
| WO | WO2008017737 | | 2/2008 | |
| WO | WO 2015132521 | A1 * | 9/2015 | E04B 9/001 |

* cited by examiner

HERMETIC AND ACOUSTICALLY ABSORBENT ASSEMBLY FOR A FALSE PARTITION

BACKGROUND

The invention relates to the field of false partitions, in particular false ceilings and false walls. The invention concerns more particularly an acoustically absorbent assembly for producing false partitions.

The assembly is intended in particular, but not exclusively, to be placed inside premises, such as an apartment, a concert hall, etc, in which it is necessary, apart from concealing unaesthetic equipment such as electric cables, pipework, etc, to control the acoustic behaviour.

It is also intended to be used with luminous means to form luminous false partitions.

Conventionally, false partitions are produced from frames able to be fixed to a wall or ceiling of a room and flexible layers tensioned on these frames. Despite the increasing use thereof in various environments, the false partitions of the prior art produced with tensioned flexible layers have a major drawback, which is having poor acoustic properties. The tensioned layers in fact reflect sound waves, then generating a significant phenomenon of reverberation (or echo) of the sound waves.

In order to overcome this drawback, providing flexible layers provided with microperforations is known from the prior art, in order to increase the absorption of the sound and therefore to attenuate the reflection of sound waves. The microperforated layers do however have the drawback of not being impervious to air, dust and moisture. Moreover, the presence of microperforations allows the passage of air giving rise to dirt.

In order to attempt to overcome these drawbacks of microperforated layers, a flexible layer composed of a first solid fabric and a second perforated fabric was proposed in the application EP 2 078 796, said fabrics being superimposed and assembled at the periphery on an attachment means able to cooperate with rails. The second fabric (the microperforated fabric) is disposed with respect to the first fabric (the solid fabric) so as to be placed on the side visible from the room interior.

Thus, through the presence of a solid fabric, the problems of impermeability are solved. Nevertheless, the presence of the solid fabric has an influence on the global acoustic performances of the tensioned layer. A drop in coefficient of absorption of the tensioned layer has in fact been observed, in particular for sound frequencies above 300 Hz, reaching unsatisfactory values (below 0.35).

There is also known, from the application EP 2 472 018, an acoustically absorbent assembly intended to form, inside an enclosure, at least one partition element, the assembly comprising at least two supports provided with microperforations and a support not comprising microperforations, the support not comprising microperforations being placed on the side that is visible from the inside of the room. Although the acoustic assembly described has satisfactory efficacy, a drop in acoustic performances of the assembly is observed for sound frequencies above 300 Hz, reaching a coefficient of absorption below 0.35 for frequencies above 300 Hz.

SUMMARY

The invention aims to remedy these problems by proposing a hermetic assembly offering satisfactory acoustic properties over an extensive range of frequencies, and in particular for frequencies above 300 Hz.

Satisfactory acoustic properties means an assembly having a coefficient of absorption of sound waves greater than or equal to 0.35.

To this end, and according to a first aspect, the invention proposes an acoustic absorbent assembly intended to constitute, inside premises, a partition element able to be fixed to at least one partition for producing false partitions, comprising two fabrics parallel to each other and assembled at the periphery on an attachment means, one of the fabrics being free from perforations, said fabrics defining respectively an inner fabric and an outer fabric when the assembly is fixed to the partition, the acoustically absorbent assembly being characterised in that the outer fabric is disposed at a given distance from the inner fabric and comprises microperforations arranged so as to form an acoustic fabric.

The expression "outer fabric" means the fabric visible from the room when the assembly is fixed to a wall partition or the ceiling, and "inner fabric" means the fabric disposed between the outer fabric and the wall partition or the ceiling.

Also microperforations means perforations having a diameter of less than 5 millimetres. According to a preferred embodiment, the microperforations have a diameter of less than 0.1 millimetres.

Thus, and surprisingly, the combination of a fabric with no microperforations (solid fabric) and a microperforated fabric disposed on the visible side of the room, at a given distance from the non-microperforated fabric, improves the acoustic properties for frequencies above 300 Hz beyond a coefficient of 0.35.

The acoustically absorbent assembly according to the invention thus makes it possible to produce hermetic false partitions having satisfactory acoustic properties in a broadened range of frequencies.

According to the type of false partition envisaged, optionally, the partition element comprises or not a frame. In the first configuration, the two fabrics will be fixed to a frame intended to be attached to a partition to be concealed via fixing systems of the suspension type. In the second configuration, the two fabrics will be fixed directly tensioned between two partitions by means of rails.

Advantageously, the inner fabric and the outer fabric are disposed at a distance from each other of between 30 and 200 millimetres, and preferably around 80 millimetres.

Advantageously, the outer fabric has a density of microperforations greater than 100 microperforations/$m^2$.

Advantageously, the outer fabric has a uniform distribution of microperforations.

Advantageously, provision is made for the inner fabric to be translucent or transparent. Likewise, provision may be made for the outer fabric to be translucent or transparent.

Advantageously, at least one of the fabrics is produced from polyvinyl chloride.

The invention also concerns a false partition, of the false wall partition or false ceiling type, comprising at least one acoustically absorbent assembly as described above.

Advantageously, provision is made for the acoustically absorbent assembly to be mounted on the partition of the premises so that the inner fabric is disposed at a distance from the partition greater than the distance separating the inner fabric from the outer fabric.

Advantageously, the false partition comprises luminous means placed between the partition and the inner fabric of the acoustically absorbent assembly. According to an advantageous embodiment, the inner and outer fabrics are translucent. The advantage of such an arrangement is to form a backlit false partition offering satisfactory acoustic behaviour, the inner fabric providing the diffusion of the light while masking the luminous means because of its translucence, the outer fabric providing the acoustic behaviour because it comprises microperforations and is placed at a given distance from the inner fabric.

In the particular embodiment where the false partition constitutes a false ceiling, provision may be made for arranging the acoustically absorbent assembly so that the inner fabric of said assembly extends substantially parallel to the partition of the room ceiling, at a distance of between 150 and 250 millimetres.

BRIEF DESCRIPTION OF THE FIGURES

Other objects and advantages of the invention will emerge during the following description given with reference to the accompanying drawings, in which.

DETAILED DESCRIPTION

Figure 1:
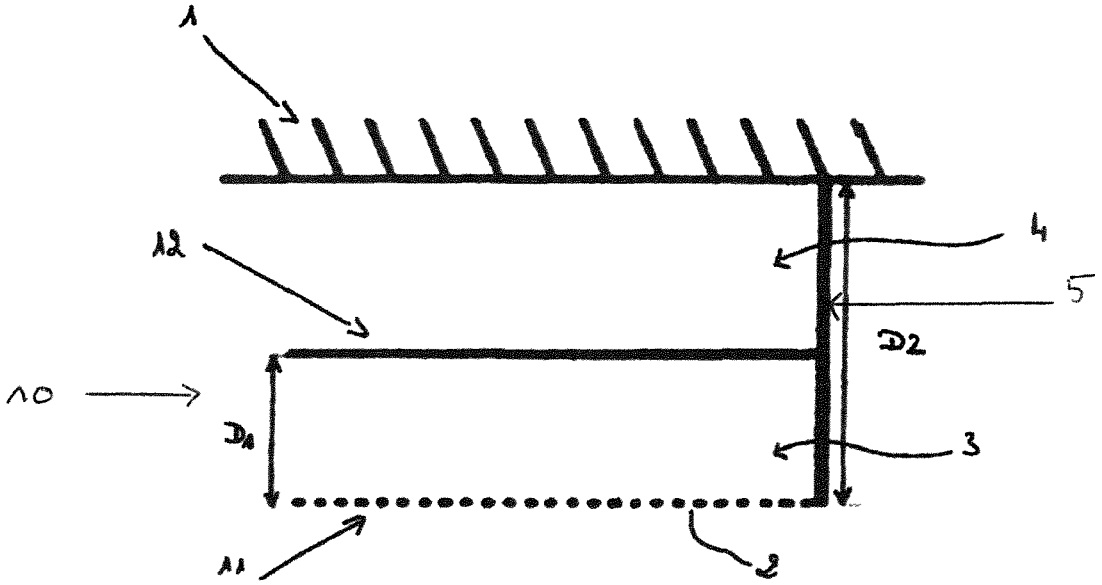
FIG. 1 depicts a partial schematic view in cross section of a false ceiling comprising an acoustically absorbent assembly according to the invention.
Figure 2:
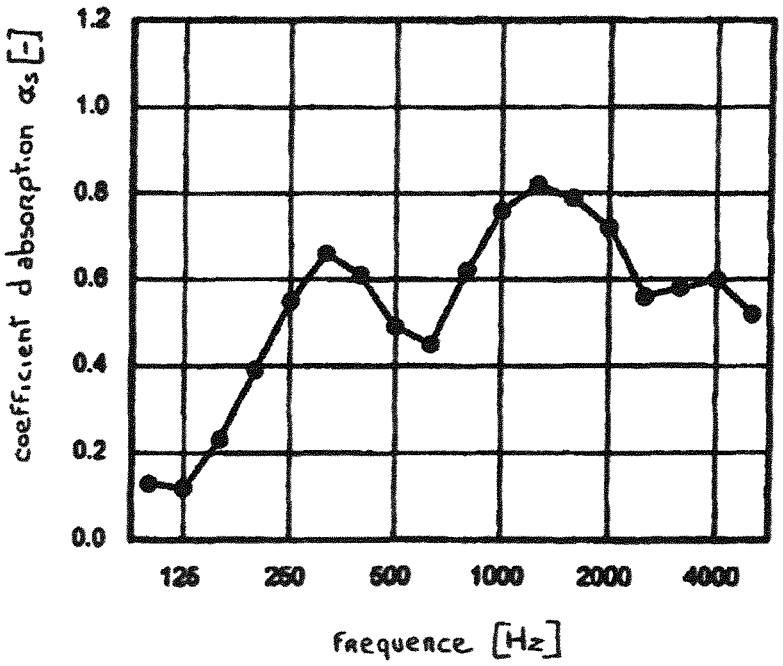
FIG. 2 is a graph showing the variation in the sound absorption of the acoustic assembly of FIG. 1 according to the sound frequency emitted.

In relation to FIG. 1, a false ceiling is described, fixed to the ceiling 1 of a room, the false ceiling comprising an acoustically absorbent assembly 10 according to the invention.

In the embodiment described, the assembly 10 comprises two tensioned fabrics 11, 12, preferably made from polyvinyl chloride (PVC), disposed parallel to each other at a given distance D1 from each other. In order to provide a "sealed" assembly, said fabrics 11, 12 are assembled hermetically at the periphery by means of an attachment means such as a rail or frame (not shown). The fabrics 11, 12 extend parallel to the partition 1 (here the ceiling 1) to which the assembly 10 is fixed. In the embodiment illustrated, the acoustic assembly 10 is fixed to a support 5 itself fixed to the partition 1. Advantageously, the support 5 and the attachment means are formed in a single piece. Provision may however be made for the support 5 to form a piece separate from the anchoring means without departing from the scope of the invention.

In the embodiment illustrated, the top fabric 12 constitutes a so-called inner fabric while the bottom fabric 11, visible from the room, constitutes a so-called outer fabric. In other words, and in general terms, the outer fabric 11 constitutes the fabric disposed on the same side as the inside of the room while the inner fabric constitutes the fabric disposed between the outer fabric and the partition to which the false partition is fixed, in this case the ceiling 1.

When it is a case of fabrics intended to be used, in the example described, to form a false ceiling, the outer fabric 11 will also be referred to as the bottom fabric and the inner fabric 12 the top fabric.

According to the invention, the outer fabric 11 (or bottom fabric) comprises microperforations 2 arranged and distributed on the fabric so as to form a fabric acoustically absorbing sound. As indicated previously, microperforations mean any perforations having a diameter of less than or equal to 2 millimetres.

According to an advantageous embodiment, the bottom fabric has a perforation density greater than 1000 microperforations/$m^2$. It is of course evident that the invention is not limited to such a density and that the latter may be adjusted according to the required acoustic behaviour of the room.

Moreover, and advantageously, the microperforations are distributed uniformly over the fabric in order to ensure an identical acoustic behaviour of the fabric whatever the location of the source of sound in the room.

The inner fabric 12 (or top fabric) is for its part a solid fabric, that is to say with no perforation or microperforation. Advantageously, the fabric 12 is dust-tight.

The presence of the microperforated fabric disposed under the non-microperforated fabric 12 preserves the satisfactory acoustic properties for the assembly 10, in particular at emitted sound frequencies of greater than 300 Hz.

Figure 3:
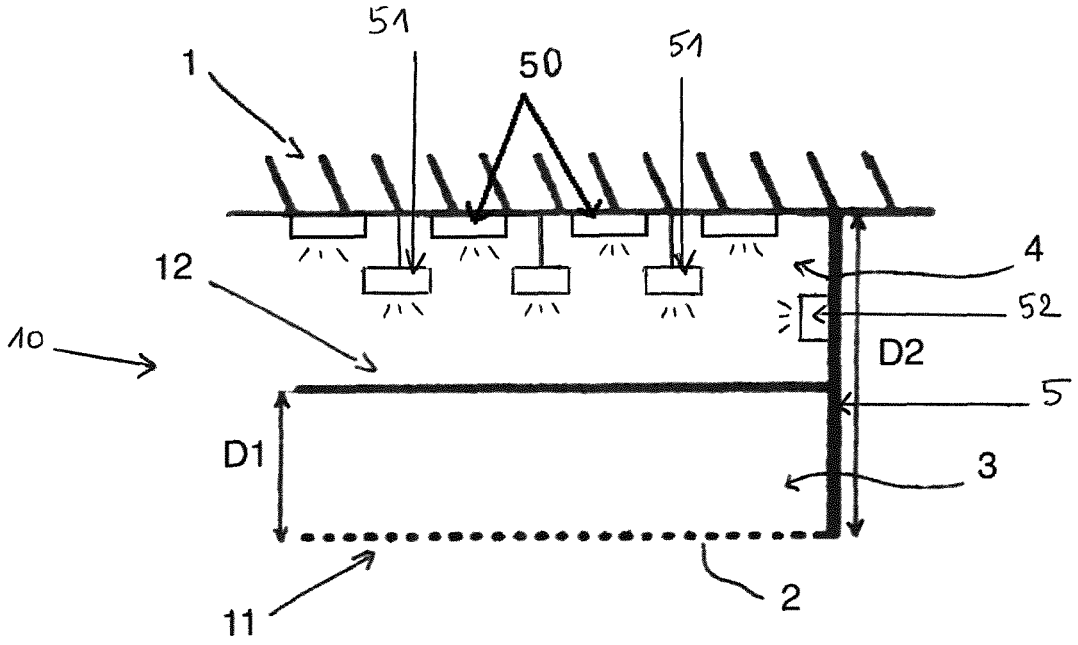
FIG. 3 shows a partial view of a false ceiling according to a variant embodiment of the invention.

The graph illustrated in FIG. 3 shows the absorption spectrum of the assembly 10 thus arranged.

Advantageously, the distance D1 between the two fabrics 11, 12 is between 30 and 200 millimetres. In the embodiment described, provision is made for fixing the assembly 10 under the ceiling at a height such that the outer fabric 11 is at a distance D2 from the ceiling of around 200 millimetres, the inner fabric 12 being at a distance D1 from the outer fabric 11 of around 80 millimetres. This is of course an example embodiment and other arrangements may be provided. However, in order to ensure satisfactory acoustic performances of the assembly 10, it will be advantageous to provide an arrangement of the assembly 10 so that the non-microperforated inner fabric 12 is disposed at a distance from the ceiling greater than the distance D1 provided between the microperforated fabric and the non-microperforated fabric.

In the embodiment illustrated, the acoustic assembly is fixed to the partition to be "covered" (in this case the ceiling 1). It is of course obvious that provision may be made for the acoustic assembly 10 to be fixed to partitions adjacent to the partition to be "covered" without departing from the scope of the invention.

Moreover, in the embodiment described, the top fabric 12 (or inner fabric) is translucent. According to a variant embodiment, the inner fabric is transparent. The use of this type of fabric, whether translucent or transparent, with or without patterns, advantageously makes it possible to create aesthetic luminous effects by providing in particular luminous means in the residual spaces 3, 4 provided respectively between the bottom fabric 11 and the top fabric 12 or between the top fabric 12 and the ceiling.

FIG. 3 illustrates the presence of luminous means 50, 51, 52 in the residual space 4 provided between the top fabric 12 and the ceiling 1. In the embodiment illustrated, the luminous means 50, 51, 52 are fixed at the ceiling 1, at a distance from the ceiling and also on the support 5. The invention is not limited to this configuration with regard to the location of the luminous means and that any other arrangement may be provided without departing from the scope of the invention. Likewise, in FIG. 3, the luminous means 51 placed at a distance from the ceiling are shown at the same height with respect to the ceiling 1. It is possible to position the luminous means at heights with respect to the ceiling that are different from one another without departing from the scope of the invention. Likewise, in the embodiment illustrated, the luminous means 50, 51 are fixed individually to the ceiling 1. The means may be fixed to the ceiling by means of a common base without departing from the scope of the invention. In order to mask the luminous means 50, 51, 52, the top fabric 12 is advantageously translucent.

The invention is described above by way of example. Naturally a person skilled in the art is in a position to implement various variant embodiments of the invention without departing from the scope of the invention.

The invention claimed is:

1. An acoustically absorbent assembly intended to constitute, inside premises, a partition element able to be fixed to at least one partition for producing false partitions, consisting of:

only two fabrics parallel to each other and assembled on an attachment means at a periphery of said two fabrics, said fabrics defining respectively an inner fabric and an outer fabric when the assembly is fixed to the partition, one of the fabrics being free from perforations, wherein the outer fabric is disposed at a given distance from the inner fabric and said outer fabric comprises microperforations configured as an acoustic fabric.

2. An assembly according to claim 1, wherein the inner fabric and the outer fabric are disposed at a distance from each other of between 30 and 200 millimeters.

3. An assembly according to claim 2, wherein the distance between the inner fabric and the outer fabric is about 80 millimeters.

4. The assembly according to claim 1, wherein the outer fabric has a density of microperforations greater than 1000 microperforations/$m^2$.

5. An assembly according to claim 1, wherein the outer fabric comprises a uniform distribution of microperforations.

6. An assembly according to claim 1, wherein the inner fabric is at least one of translucent and transparent.

7. An assembly according to claim 1, wherein the outer fabric is translucent or transparent.

8. An assembly according to claim 1, wherein at least one of the fabrics is produced from polyvinyl chloride.

9. A false partition comprising at least one acoustically absorbent assembly, said acoustically absorbent assembly consisting of:

only two fabrics parallel to each other and assembled on an attachment means at a periphery of said two fabrics, said fabrics defining respectively an inner fabric and an outer fabric when the assembly is fixed to the partition, one of the fabrics being free from perforations, wherein the outer fabric is disposed at a given distance from the inner fabric and said outer fabric comprises microperforations configured as an acoustic fabric.

10. The false partition according to claim 9, wherein the acoustically absorbent assembly is mounted on a wall of a room so that the inner fabric is disposed at a distance from the false partition greater than the distance separating the inner fabric from the outer fabric.

11. The false partition according to claim 9, wherein said false partition comprises luminous means placed between the wall and the inner fabric of the acoustically absorbent assembly configured as a backlit false partition.

12. A false-ceiling fixed to a ceiling, said false-ceiling comprising:

an acoustically absorbent assembly consisting of:

no more than two fabrics parallel to each other and assembled hermetically at a periphery of said two fabrics by an attachment means, said fabrics defining respectively an inner fabric and an outer fabric, said outer fabric being disposed at a given distance from the inner fabric, said outer fabric comprising microperforations configured as an acoustic fabric while said inner fabric is free from perforations.

* * * * *